United States Patent [19]

Stenudd

[11] 4,202,638

[45] May 13, 1980

[54] DEVICE FOR POINTWISE ACTION ON AN INFORMATION CARRYING MEDIUM

[75] Inventor: Sven G. V. Stenudd, Lidingo, Sweden

[73] Assignee: Facit Aktiebolag, Atvidaberg, Sweden

[21] Appl. No.: 840,746

[22] Filed: Oct. 11, 1977

[30] Foreign Application Priority Data

Oct. 11, 1976 [SE] Sweden ..... 7112564

[51] Int. Cl.[2] ..... B41J 3/10

[52] U.S. Cl. ..... 400/124; 101/93.02

[58] Field of Search ..... 400/124, 167, 121; 101/93.02, 93.04; 335/271

[56] References Cited

U.S. PATENT DOCUMENTS

| | | | |
|---|---|---|---|
| 3,148,313 | 9/1964 | Hancock | 335/271 X |
| 3,333,667 | 8/1967 | Nordin | 400/124 |
| 3,836,880 | 9/1974 | Matschke et al. | 400/124 X |
| 3,896,918 | 7/1975 | Schneider | 400/124 |
| 3,968,867 | 7/1976 | Stenudd | 400/124 |
| 4,049,107 | 9/1977 | Murat | 400/124 |
| 4,049,108 | 9/1977 | Giessner | 400/124 |

*Primary Examiner*—Paul T. Sewell

*Attorney, Agent, or Firm*—Alfred E. Miller

[57] ABSTRACT

A device for marking an information carrying medium has an arm with a pointed tip adapted to engage the medium. The arm is spring biased for movement in one direction, and a solenoid structure is provided for moving the arm in the other direction. A land surface cooperates with the arm to form an air pressure damping arrangement to damp movements of the arm in a direction away from the information carrying medium.

11 Claims, 4 Drawing Figures

DEVICE FOR POINTWISE ACTION ON AN INFORMATION CARRYING MEDIUM

BACKGROUND OF THE DISCLOSURE

This invention relates to a device for acting at a point on an information carrying medium, for instance for punching holes or printing characters, composed of dots, dashes or the like, in a medium such as a tape or sheet. In this type of device, a point or the like for acting on the medium is adapted to be struck or pressed against a surface of the medium. An elongated arm extends primarily parallel to the surface, is provided with or has the form of said point at one of its ends, and is connected to a spring device in the region of its other end. In addition, the arm is under the influence of a drive device and is resiliently swingable in a direction to or from the surface of the medium.

Such arms can be used as printing arms in printing heads of matrix type, i.e. in which the printed characters are formed of a number of dots. In printing heads of this kind, the printing arms must reciprocate at a very high frequency to obtain a more rapid printing speed. As a result, problems limiting the printing speed often occur. Even if the printing point fastened on the arm can be made to strike the recording medium with a short delay and at a high speed, difficulties in the return movement of the arms often occur. Evidently, this movement must also be very rapid in order not to limit the printing speed. On the other hand, the return movement must be stopped in such a way that the arms attain their rest position without a tendency to bounce. To this end, some kind of a mechanical damper is often used, for instance a rubber cushion, for absorbing the kinetic energy. However, in practice this solution functions badly, e.g., due to wear, which rapidly destroys the damper.

Similar problems also occur in tape punchers.

SUMMARY OF THE INVENTION

The invention is therefore directed to the provision of an improved damper. Briefly, stated, according to the invention, this is achieved by providing a device wherein the arm, or a device fastened to it, cooperates with a fixedly mounted land surface and is spaced therefrom at such a distance that a braking of the return movement of the arm after a printing or punching operation is obtained due to the increasing air pressure between the land surface and the arm and the device respectively.

BRIEF FIGURE DESCRIPTION

In order that the invention will be more clearly understood, it will now be disclosed in greater detail with reference to the accompanying drawings, wherein.

Figure 1:
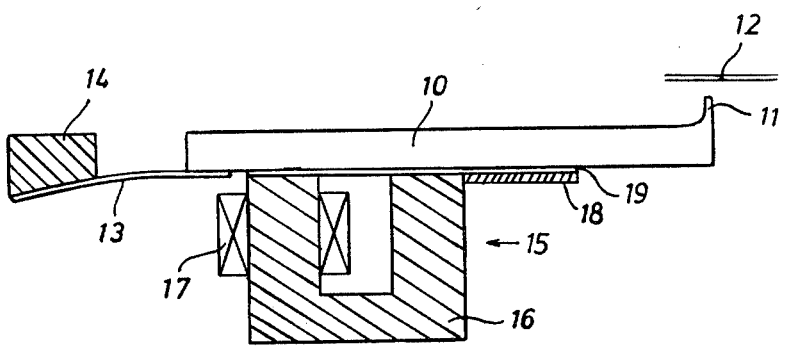
FIG. 1 is a simplified side view of a device in accordance with the invention, partially in cross-section, and showing the relationship between the device and an information carrying medium.
Figure 2:
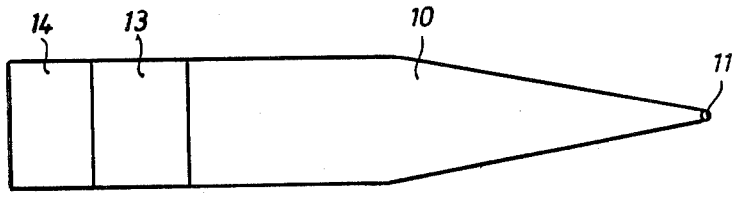
FIG. 2 is a top view of the device of FIG. 1.
Figure 3:
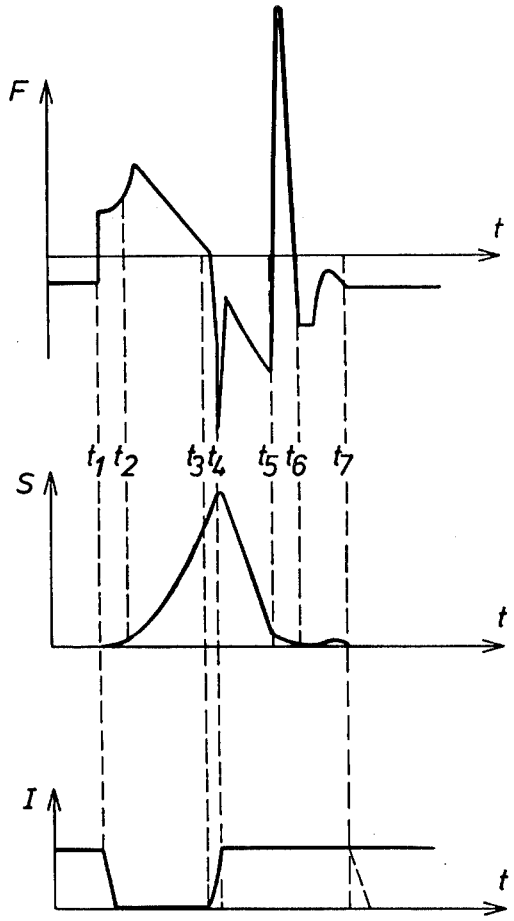
Figure 4:
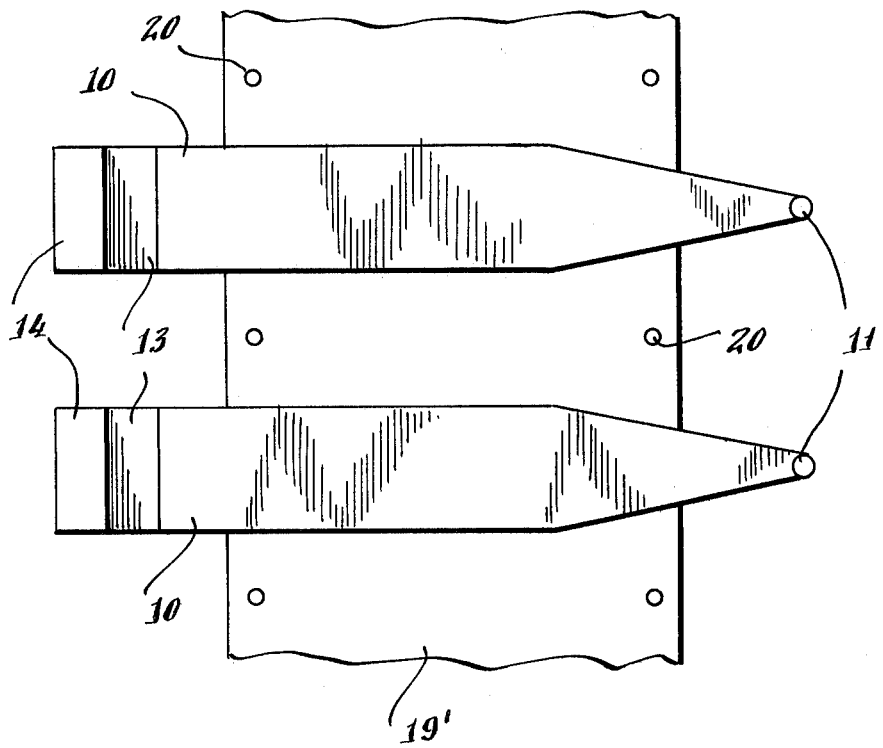

FIG. 3 comprises a set of curves showing the force F on the arm of FIGS. 1 and 2, the displacement S of the arm, and the current I through the activating magnet, as a function of time; and FIG. 4 is a top view of a modification of a device in accordance with the invention, illustrating a common foil for a plurality of activating magnets.

DETAILED DISCLOSURE

In FIGS. 1 and 2 an elongated arm 10 is shown, which is provided with or has the form of a marking tip such as point 11 at one end thereof for making markings on a diagrammatically outlined record medium 12. These markings may for example be printed dots, as in matrix printers, or holes in a punched tape or the like. As seen in FIG. 2, the width of the arm 10 increases from the pointed end. The reason for this will be explained later on in connection with the air damping function. At its opposite end the arm is fastened to a leaf spring 13, which in turn is fastened to a stationary support or stand 14. The leaf spring 13 tends to swing the arm anti-clockwise in FIG. 1, i.e., so that the point 11 is moved towards the record medium 12.

An electromagnet 15 consisting of a core 16 and a winding 17 (for the sake of clearness a sectional view of the electromagnet is shown in the figure), is stationarily mounted with respect to the stand 14 and cooperates with the arm 10. The arm thus functions as an armature. When the magnet is energized the arm 10 is attracted to the core so that the point 11 is drawn away from the record medium 12 against the force of the leaf spring 13.

The movement of the arm 10 when the magnet is energized is limited by the pole faces of the magnet core, as well as by a land surface such as stopping disc 18. The disc is fixed in relation to the stand 14 and the magnet 15, and is positioned at the same level as the pole surfaces of the magnet. In order to prevent metallic contact between the arm 10 and the stopping disc 18, a thin foil 19 is placed on the stopping disc 18. The foil 19, which may be of a plastic material, mica, or another suitable non-magnetic material, also extends over the core surfaces of the electromagnet. In addition to preventing metallic contact, the foil also serves as abrasion protection. Its most important function, however, is to serve as an air seal against the disc 18 and the core surfaces of the magnet when the arm 10, due to the attraction of the electromagnet, returns after a printing or punching operation.

The air damping function during a printing or punching operation will now be more clearly described with reference to FIG. 3, which, as a function of time shows the total force F acting on the arm 10, as well as the energizing current I of the magnet 15 and the displacement S of the arm.

Referring now to FIG. 3, when the energizing current I ceases at the time $t_1$, the force of the leaf spring 13 on the arm 10 is at the beginning of armature movement, counteracted by the vacuum between the arm 10 and the foil 19. At the time $t_2$ the arm 10 has moved far enough from the foil 19 for this influence to have completely ceased, permitting the spring force to act to its maximum extent. Just prior to the time the point 11 strikes against the record medium 12, the energizing current is reconnected (at the time $t_3$), but owing to the rise time of the current and the inertia of the arm, the arm proceeds to strike the medium at the time $t_4$, whereby the generated pressure force stops the arm movement. This pressure force is represented by the rather strong negative pulse at $t_4$. When this force ceases the energizing current has instead increased to such an extent that the arm continues its return movement. This is also illustrated by the force curve growing more and more negative. When the arm has returned so far that it has come comparatively close to the foil 19 (at the time $t_5$) a strong opposing force will arise due to air compression, which is illustrated by the force curve suddenly growing to a large positive value. The braking effect thereby becomes very great, and the movement of the arm is completed very softly and without a heavy impact against the foil 19. Due to this air damping, most of the kinetic energy of the arm is dissipated, and the rebound tendency to which the residual energy gives birth and which starts at the time $t_6$, is almost completely prevented by the vacuum formed between the arm 10 and the foil 19, and by the attraction of the magnet. The vacuum force just mentioned is the reason for the "dip" of the force diagram just after the time $t_6$. Then stabilization is obtained at a force caused only by the magnet 15. This state has been reached at the time $t_7$, when a new printing or punching operation can start.

In order that the just described air pressure damping shall be strong enough, the surface of the arm 10 cooperating with the foil 19 may not be too small, and this is the reason for the expanding shape of the arm 10. It is of course obvious that other shapes than the triangular shape shown in the example can alternately be employed. If, for instance, available space does not require the arm to be narrow at its point 11, it is in this case quite permissible for the arm to be rectangular and thereby to have a considerable width along its whole length.

If, as is usually the case with mosaic printing heads, a number of printing arms are provided together in a joint printing head (see for instance the Swedish patent publication No. 384 934) the stopping disc as well as the foil are preferably made and mounted to serve in common for all of the printing arms, as shown in FIG. 4. The foil 19' needs only to be fixed at its sides by a couple of brads 20 or the like, it is not necessary for the foil to be affixed to the stopping disc since it is kept in place against the stopping disc owing to the fact that the area of the foil against the stopping disc is larger than its area against the relevant surfaces of the arms. Therefore, the vacuum force acting against the stopping disc becomes greater than against the arms because of the longer distance air must penetrate to break the seal against the stopping disc. An even safer adhesive capacity of the foil against the stopping disc is provided if a thin layer of oil is provided between the foil and disc.

While the invention has been disclosed and described with reference to a single embodiment, it will be apparent that variations and modifications may be made therein. For example, instead of employing a magnet which is active to pull the arm away from the information carrier, it will be apparent that a magnet structure may be alternately arranged to pull the arm toward the information carrier. In this case, the spring 13 should be mounted to bias the arm in the opposite direction. The stopping surface 18 will of course still be fixedly mounted to stop the displacement of the arm in the return direction, and the foil 19 will be positioned to cooperate with the stopping piece. It will of course be apparent that in this instance the area of the stopping surface and foil must be adequate to obtain the desired air pressure damping effect of the invention. In a further modification of the invention, the air damping effect may be obtained by the use of a wing affixed to the arm proper, rather than on the arm itself. In such instance, of course, the foil and stopping surface will be positioned to cooperate with the wing. In such an arrangement, the arm itself may have a constant narrow width. In the modification of this latter structure, the wing may alternatively be integral with the leaf spring, for example, in order to simplify the manufacture of the device. It is further apparent that the invention is not limited to the marking of the medium by means of dots or dashes and the like. It is further apparent that the timing of the current wave form, as illustrated in FIG. 3, may be effected by a conventional timing circuit designed to interrupt the current for the magnet for a determined period dependent upon the mechanical characteristics of the marking device.

It is therefore intended in the following claims to cover each such variation and modification as falls within the true spirit and scope of the invention.

What is claimed is:

1. In a device for marking an information carrying medium in which a marking tip is provided on an arm means, first means are provided for moving the arm means in a first direction to urge the marking tip against a surface of the information carrying medium, and second means are provided for moving the arm means in a second direction to move the tip away from the information carrying medium, the arm means extending generally parallel to the surface of said information carrying medium and having a planar surface portion; the improvement comprising additionally a fixedly mounted land surface positioned to inhibit the displacement of said arm means in said second direction and being oriented precisely parallel to said planar surface portion when said arm means is at its extreme extent of motion in said second direction, said land surface and arm means comprising in combination an air pressure damping means for damping the movement of said arm means in said second direction by air pressure, said land surface being lateral of said second means along said arm.

2. The device of claim 1 wherein said arm means comprises an elongated arm, and said marking tip comprises a pointed end on said arm for marking said information carrying medium with marks.

3. The device of claim 2 further comprises a thin foil between said land surface and said arm, said foil being held with respect to said land surface.

4. The device of claim 3 further comprising a layer of oil between said land surface and said foil.

5. The device of claim 2 wherein said first means for moving comprises a leaf spring coupled to the other end of said arm for biasing said arm, and said second means for moving comprises an electromagnet positioned to attract said arm, said arm thereby forming an armature, whereby said electromagnet may be energized to receive electrical impulses for controlling its operation.

6. The device of claim 5 wherein said first means for moving comprises said spring, and said second means for moving comprises said electromagnet.

7. The device of claim 2 further comprising additional arm means having marking tips and being mounted in a common row with said first mentioned marking means for marking said information carrying medium, said land surface being positioned to inhibit displacement of said additional arm means in said second direction, and further comprising a common foil fixedly held with respect to said land surface and separate said land surface from said first mentioned and additional arm means.

8. The device of claim 2 wherein said land surface comprises a fixedly mounted stopping disc.

9. The device of claim 1 wherein said land surface and arm means have opposing surfaces adapted to contact one another, said land surface being non-magnetic.

10. The device of claim 1 wherein one of said means for moving comprises an electromagnet positioned to attract said arm, said electromagnet having a core, and wherein said land surface is fixedly mounted to extend from said core.

11. The device of claim 1 wherein said land surface is positioned adjacent said second means.

* * * * *

UNITED STATES PATENT OFFICE

CERTIFICATE OF CORRECTION

PATENT NO. : 4,202,638

DATED : May 13, 1980

INVENTOR(S) : SVEN G. V. STENUDD

It is certified that error appears in the above-identified patent and that said Letters Patent are hereby corrected as shown below:

Change Foreign Application Priority Data from "7112564 to -- 7611256 --.

Signed and Sealed this

*Twenty-ninth* Day of *July 1980*

[SEAL]

*Attest:*

SIDNEY A. DIAMOND

*Attesting Officer*

*Commissioner of Patents and Trademark*